US007011025B2

(12) United States Patent
Egan

(10) Patent No.: US 7,011,025 B2
(45) Date of Patent: Mar. 14, 2006

(54) FLEXOGRAPHIC PRINTING PLATE CLEANER

(76) Inventor: Ronald G. Egan, 1049 Gravel Rd., Webster, NY (US) 14580

( * ) Notice: Subject to any disclaimer, the term of this patent is extended or adjusted under 35 U.S.C. 154(b) by 51 days.

(21) Appl. No.: 10/453,289

(22) Filed: Jun. 4, 2003

(65) Prior Publication Data

US 2004/0244618 A1 Dec. 9, 2004

(51) Int. Cl.
*B41F 35/00* (2006.01)

(52) U.S. Cl. ..... 101/425; 101/424

(58) Field of Classification Search ..... 101/423–425; 15/256.51, 256.52, 256.53, 256
See application file for complete search history.

(56) References Cited

U.S. PATENT DOCUMENTS 3,586,062 A * 6/1971 Hindle et al. ..... 139/171
3,999,239 A * 12/1976 Misuna ..... 15/88
4,370,927 A * 2/1983 Fischer ..... 101/228
5,275,104 A 1/1994 Corrado et al. ..... 101/425
5,519,914 A 5/1996 Egan ..... 15/256.53
5,758,577 A * 6/1998 Ebina ..... 101/423
5,842,418 A * 12/1998 Corrado et al. ..... 101/425
6,354,213 B1 * 3/2002 Jenkins ..... 101/483
6,386,106 B1 * 5/2002 Stanka ..... 101/425
6,561,095 B1 * 5/2003 Michalik et al. ..... 101/425
6,561,096 B1 * 5/2003 Munz ..... 101/425

OTHER PUBLICATIONS

TRESU Printing Plate Cleaner, www.tresu.com Oxy-Dry Corporation, www.oxy-dry.com.

* cited by examiner

*Primary Examiner*—Anthony H. Nguyen
(74) *Attorney, Agent, or Firm*—Shlesinger & Fitzsimmons

(57) ABSTRACT

A flexographic printing plate cleaner comprises a linear actuator operably mounted relative to a plate cylinder carrying a flexographic printing plate; a frame carried by the linear actuator for movement along a path parallel to an axis of rotation of the plate cylinder; and a double-acting three-position cylinder carried by the frame. The cylinder includes a first piston rod a retracted position, a first extended position and a second extended position. A backing plate secured to an exterior end of the first piston rod and movable therewith. A cleaning pad is disposed in front of the backing plate and adjacent the flexographic printing plate such that the cleaning pad engages the printing plate at a first pressure when the first piston rod is at the first position, and at a second higher pressure when the first piston rod is at the second position.

21 Claims, 6 Drawing Sheets

FIG. 4
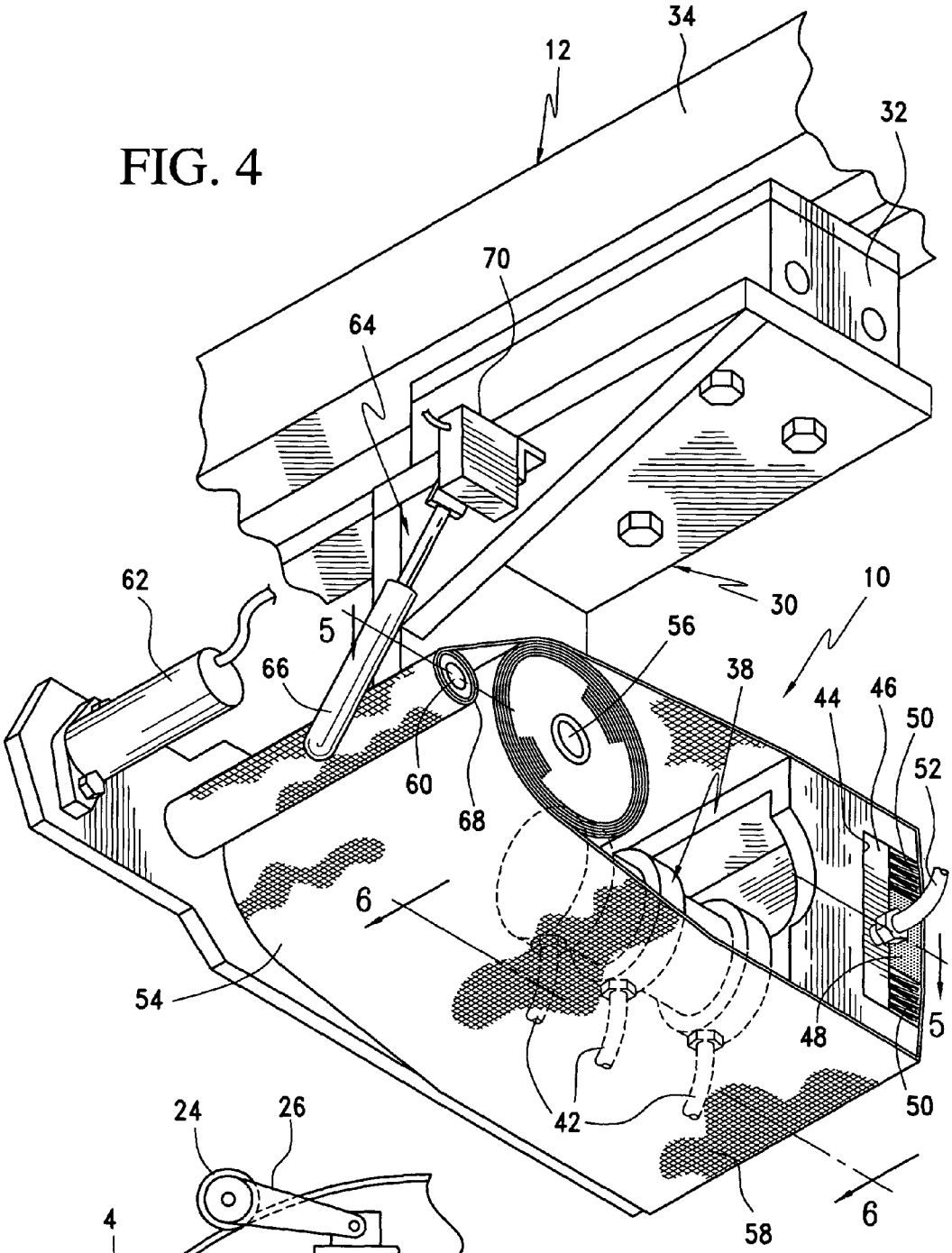
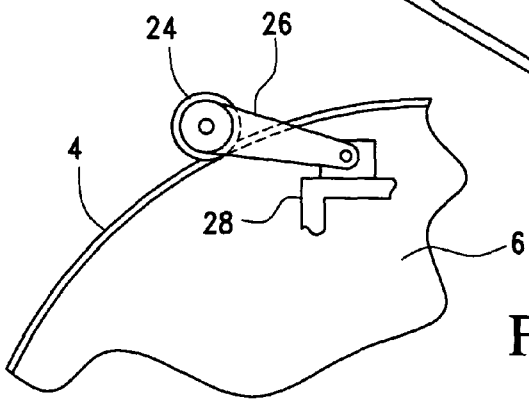
FIG. 3

FLEXOGRAPHIC PRINTING PLATE CLEANER

FIELD OF THE INVENTION

The present invention relates generally to a flexographic printing plate cleaner that can provide its cleaning function while the printing press is operating.

BACKGROUND OF THE INVENTION

The present invention is an improvement over U.S. Pat. No. 5,519,914, which is hereby incorporated by reference.

OBJECTS AND SUMMARY OF THE INVENTION

It is an object of the present invention to provide a flexographic printing plate cleaner that can operate under three modes, namely, a wipe mode for removing debris on the printing plate while the press is operating, a spot clean mode for cleaning specific location on the printing plate while the printing press is operating, and a wash mode for rinsing the printing plates while the printing press is offline.

It is another object of the present invention to provide a flexographic printing plate cleaner that provides a dual surface cleaning pad, where one surface is used for wiping the printing plate and another surface for more aggressive plate cleaning.

It is another object of the present invention to provide a flexographic printing plate cleaner that adjusts the traversing speed of the cleaning head so that the same amount of contact between the cleaning pad and the printing plate is maintained regardless of the printing machine speed.

It is another object of the present invention to provide a flexographic printing plate cleaner that provides the scrubbing efficiency of a direct contact system but is able to precisely control contact pressure and liquid flow without compromising quality during the printing operation.

It still another object of the present invention to provide a flexographic printing plate cleaner that requires relatively little maintenance, such as daily replacement of a small roll of cloth and periodic refilling of water into the pressurized vessel that can be routinely completed by production personnel.

In summary, the present invention provides a flexographic printing plate cleaner, comprising a linear actuator operably mounted relative to a plate cylinder carrying a flexographic printing plate; a frame carried by the linear actuator for movement along a path parallel to an axis of rotation of the plate cylinder; and a double-acting three-position cylinder carried by the frame. The cylinder includes a first piston rod having a retracted position, a first extended position and a second extended position. A backing plate is secured to an exterior end of the first piston rod and movable therewith. A cleaning pad is disposed in front of the pressure plate and adjacent the flexographic printing plate such that the pad engages the printing plate at a first pressure when the first piston rod is at the first position, and at a second higher pressure when the first piston rod is at the second position.

The present invention also provides a flexographic printing plate cleaner, comprising a linear actuator operably mounted relative to a plate cylinder carrying a flexographic printing plate; a cleaning head carried by the linear actuator for movement along a path parallel to an axis of rotation of the plate cylinder; and a speed encoder operably associated with the plate cylinder and the actuator to control the traverse speed of the cleaning head across the length of the printing plate during cleaning. The cleaning head has a first position away from the printing plate and a second position in engagement against the printing plate to clean the printing plate while the plate cylinder is rotating.

The present invention further provides a flexographic printing plate cleaner, comprising a linear actuator operably mounted relative to a plate cylinder carrying a flexographic printing plate; and a cleaning head carried by the linear actuator for movement along a path parallel to an axis of rotation of the plate cylinder. The cleaning head includes a cleaning pad comprising a cloth and bristles protruding through the cloth. The cleaning pad has a first position away from the printing plate and a second position in engagement against the printing plate wherein the cloth and the bristles are in engagement with the printing plate for cleaning.

These and other objects of the present invention will become apparent from the following detailed description.

BRIEF DESCRIPTIONS OF THE DRAWINGS

FIG. 3 is a schematic side view of a speed encoder for determining the speed of the plate cylinder.

FIG. 4 is a bottom perspective view of a cleaning head made in accordance with the present invention.

DETAILED DESCRIPTION OF THE INVENTION

Figure 1:
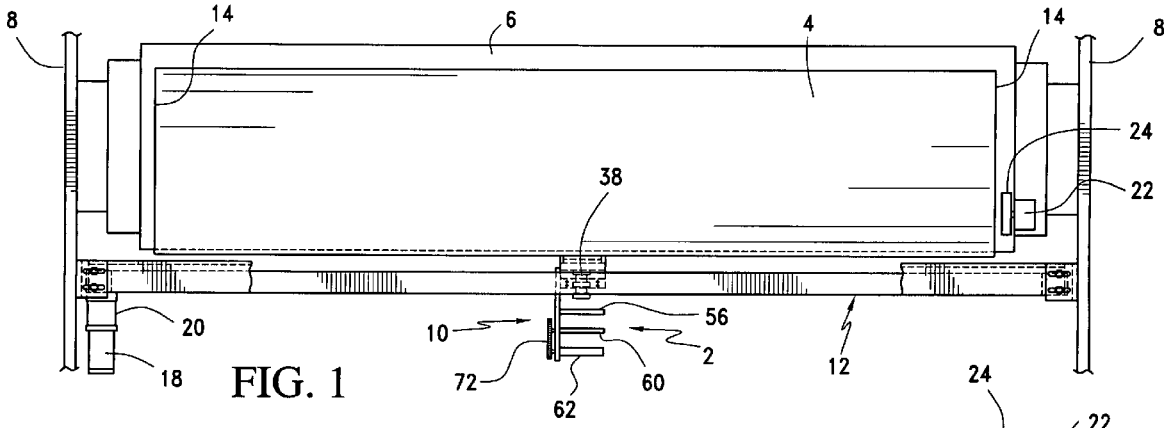
FIG. 1 is a top plan view of a flexographic printing plate cleaner of the present invention shown mounted to a printing plate cylinder assembly.
Figure 2:
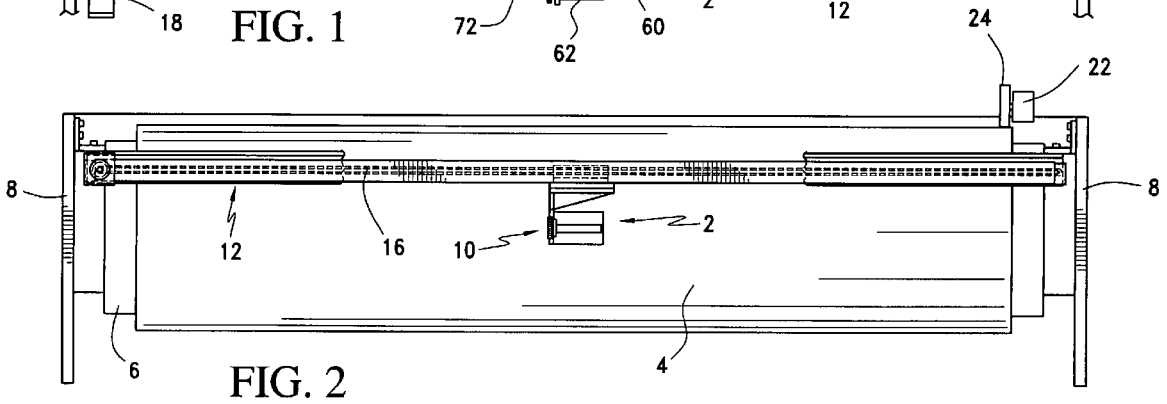
FIG. 2 is a front view of FIG. 1.

A flexographic printing plate cleaner made in accordance with the present invention is disclosed in FIGS. 1 and 2 mounted to a printing cylinder assembly. The cleaner 2 is used to clean a printing plate 4 carried by a plate cylinder 6. The plate cylinder 6 rotates along its axis between two end supports 8 during printing.

The cleaner 2 comprises a cleaning head 10 carried by a linear actuator 12 between the outer edges 14 of the printing plate 4 and to any position in-between. The actuator 12 includes an endless toothed belt 16 driven by a stepper motor 18 mated to a gear reducer 20.

A speed encoder 22 including an encoder wheel 24 provides rotational speed information to the motor 18 so that the traverse speed of the cleaning head 10 across the printing plate 4 may be adjusted automatically, depending on the rotational speed of the plate cylinder 6 so that the same amount of contact between the cleaning head 10 and the printing plate 4 is maintained regardless of the plate cylinder's speed. The encoder wheel 24 is mounted in a standard manner for rotational engagement with the plate cylinder 6 by means of a pivot arm 26 mounted to a bracket 28, as schematically shown in FIG. 3.

Referring to FIG. 4, the cleaning head 10 comprises a frame 30 secured to a carrier block 32, which in turn is operably secured to the endless belt 16 within the actuator housing 34. It will be understood that as the belt 16 is actuated clockwise or counterclockwise by the motor 18, the cleaning head 10 will traverse left or right along a linear path parallel to the axis of rotation of the plate cylinder 6.

A base structure 36 is operably secured to the frame 30. A double-acting three-position cylinder 38 is attached to the base structure 36 in a standard manner, such as by bolts 40 shown in FIG. 5. Fluid hoses 42 communicate within the cylinder 38, as will be discussed below. A front portion of the base structure 36 includes a recess 44 in which a backing plate 46 is disposed. The backing plate 46 is operably secured to the cylinder 38 as will be discussed below. A sponge pad 48 and bristles 50 are operably secured to the backing plate 46. The backing plate 46 operates as a pressure plate to transmit pressure from the cylinder 38 to the sponge pad. A cleaning fluid inlet hose 52 communicates with a passageway within the backing plate 46 to deliver the cleaning fluid to the sponge pad 48. The sponge pad is preferably open cell polyurethane foam.

A roll 54 of cloth 58 is carried by an unwind spindle 56. The cloth 58 is coursed from the roll 54 to underneath, in front and on top of the base structure 36 and wound around a rewind spindle 60 driven by a motor 62. A low cloth sensor 64 provides an alarm when the supply cloth roll 54 is nearly used up. The sensor 64 includes a pivoting arm 66 with one end in engagement with a used roll 68 and the other end being associated with a switch 70. As the used roll 68 increases in diameter, the arm 66 pivots radially, eventually activating the switch 70 to send an alarm to a controller when the used roll 68 reaches a certain diameter indicative of the cloth roll 54 being nearly used up. The low cloth sensor 64 is further described in U.S. Pat. No. 5,519,914. The cloth 58 is a highly absorbent "clean room" grade, 100% woven polyester linen available from Lymtech Scientific, Chicopee, Mass. under the designation Purity Wipes.

The rewind spindle 60 is driven by the motor 62 by conventional means such as belt 72, as shown in FIG. 1.

Figure 5:
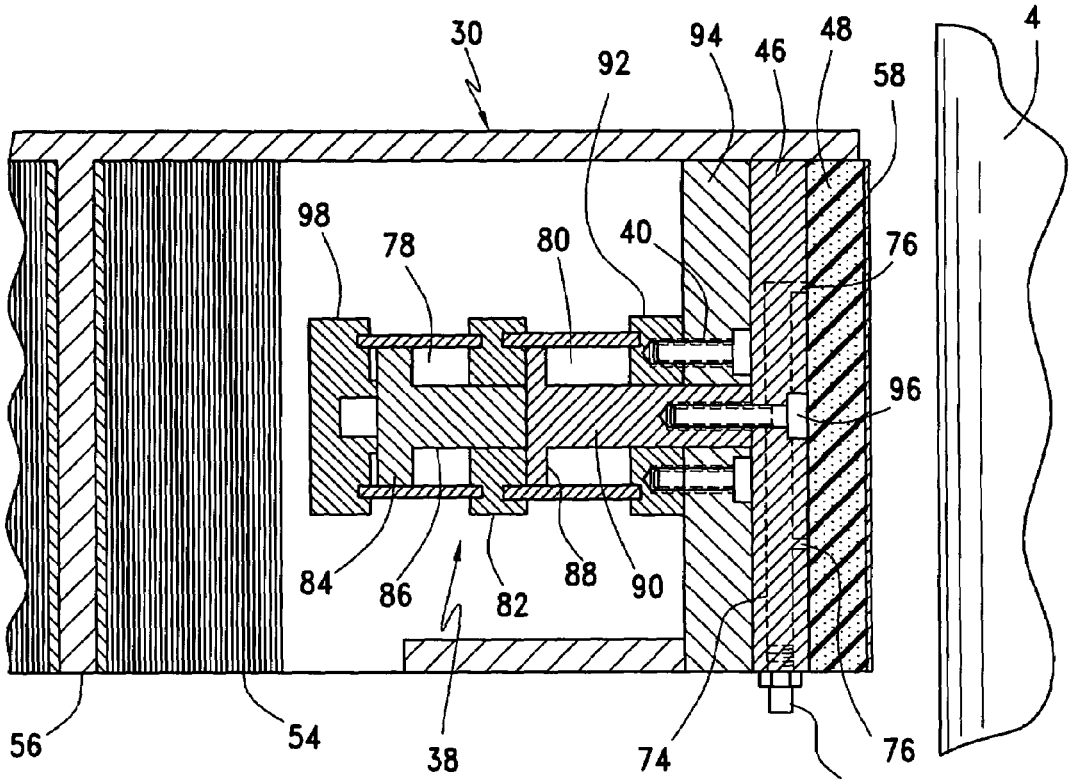
FIG. 5 is a cross-sectional view taken along line 5—5 of FIG. 4.

Referring to FIG. 5, the backing plate 46 includes a passageway 74 that communicates with the inlet hose 52 and outlet ports 76 to deliver the cleaning fluid from a reservoir to the sponge pad 48 and to the cloth 58. Since the sponge pad 48 is in direct contact with the cloth 58, the cleaning fluid in the sponge pad is absorbed by the cloth.

Figure 6:
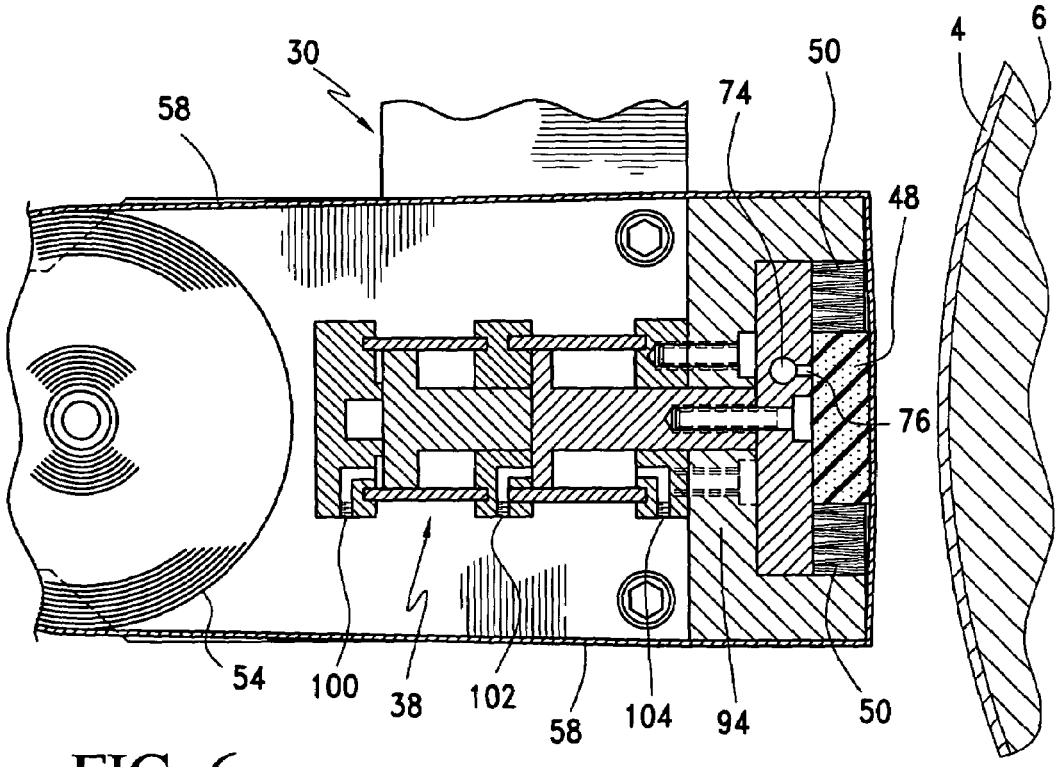
FIG. 6 is a cross-sectional view taken along line 6—6 of FIG. 4.

Referring to FIG. 6, the bristles 50 are disposed along the top and bottom edges of the sponge pad 48. The bristles 50 are slightly shorter than the thickness of the sponge pad 48.

The cylinder 38 comprises chambers 78 and 80 separated by a wall 82. A piston 84 with a piston rod 86 is disposed in the chamber 78. A piston 88 with its associated piston rod 90 are disposed within the chamber 80. The piston rod 86 extends through an opening in the wall 82 and engages the piston 88. The piston rod 90 extends through an opening through an end wall 92 and through an opening in a bottom wall 94 of the recess 44. A bolt 96 or other standard means secures the piston rod 90 to the backing plate 46. An end wall 98 encloses the chamber 78. Fluid inlet port 100 communicates with the chamber 78 and inlet ports 102 and 104 with the respective chamber 80, as best shown in FIG. 6.

Figure 7:
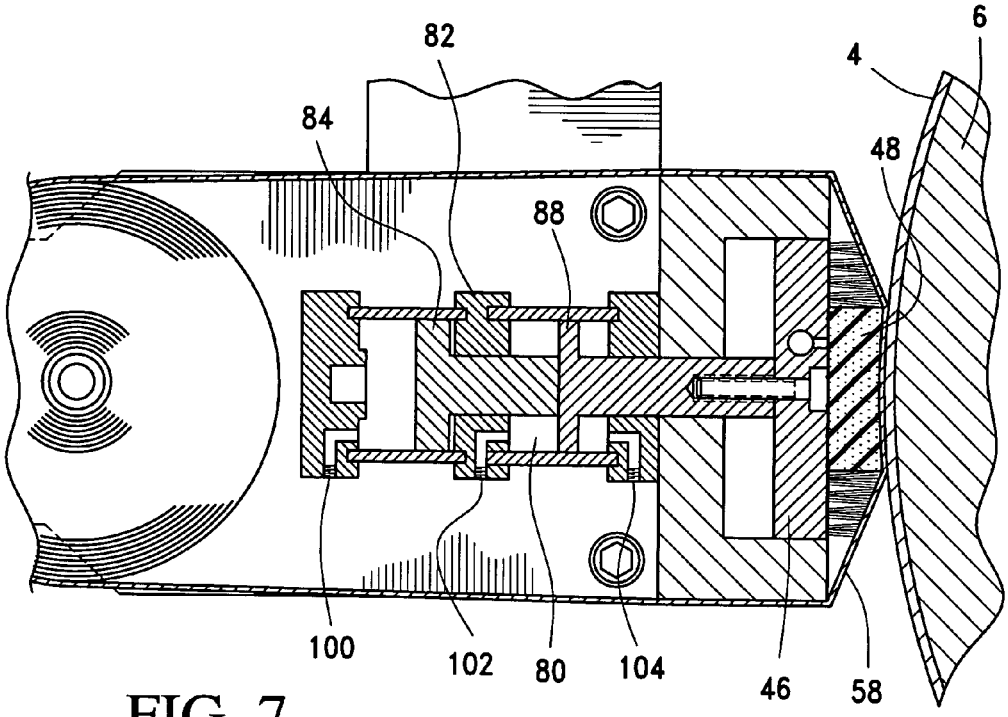
FIG. 7 is similar to FIG. 6, but showing the cylinder extended to an intermediate position.
Figure 8:
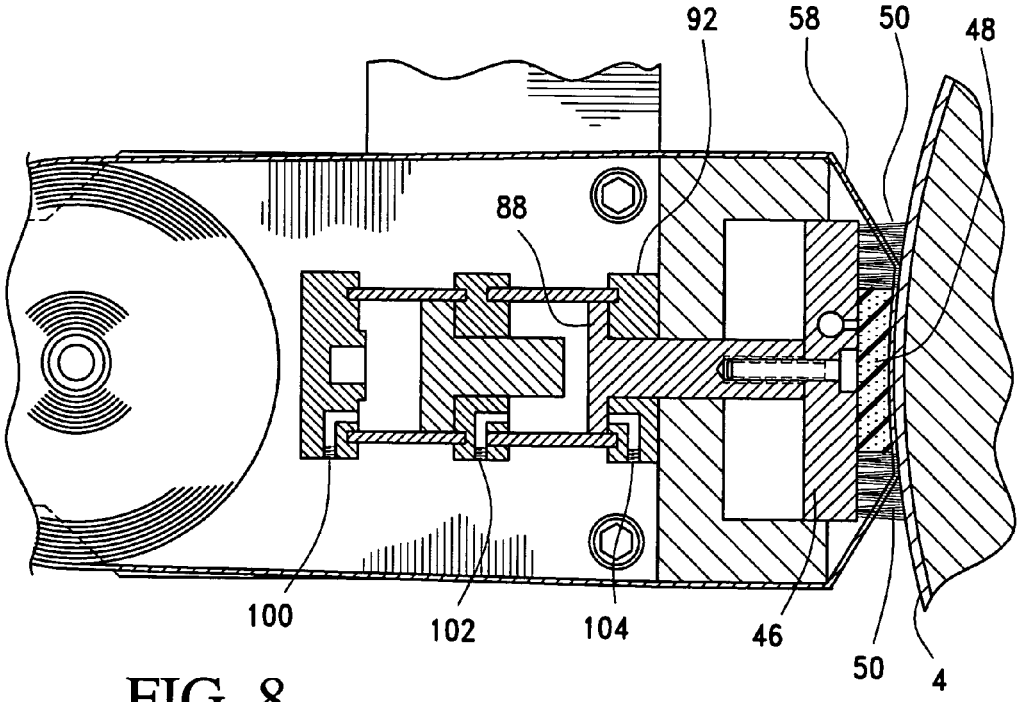
FIG. 8 is similar to FIG. 6, but shows the cylinder extended to its fully extended position.
Figure 9:
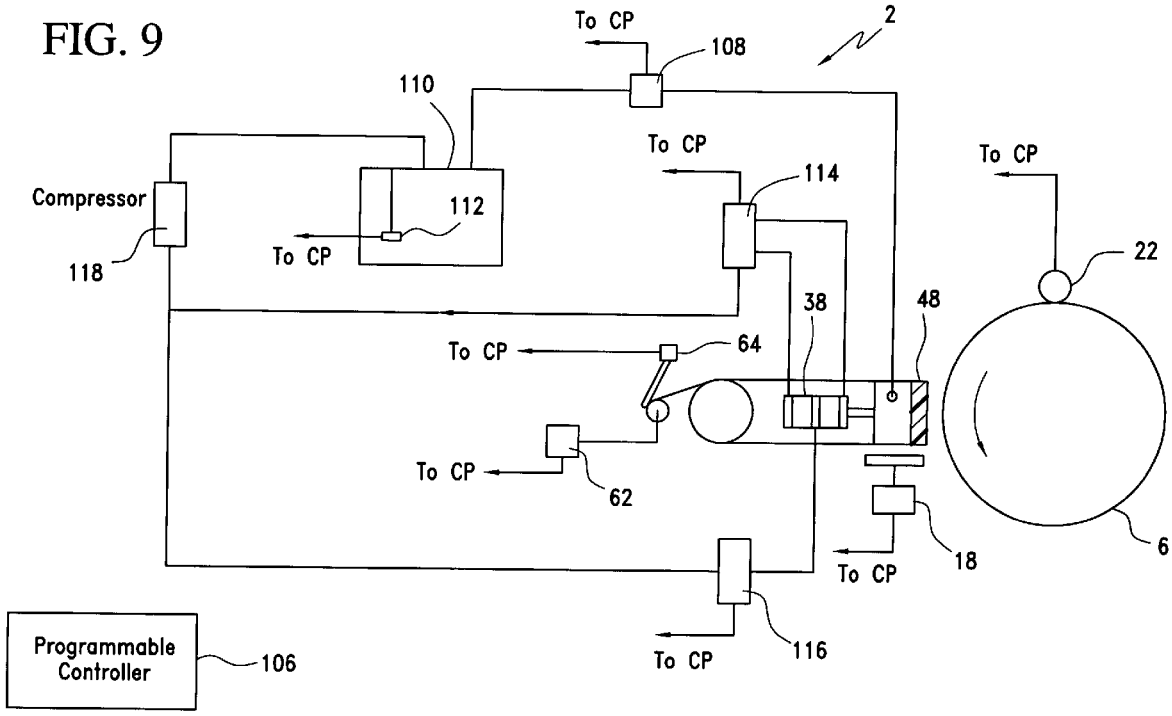
FIG. 9 is a schematic diagram of the interconnection of the various components of the flexographic printing plate cleaner of the present invention.

The cylinder 38 has a fully retracted position, as shown in FIGS. 5 and 6, an intermediate extended position, as shown in FIG. 7 and a fully extended position, as shown in FIG. 8. In the retracted position, the pistons 84 and 88 are both retracted and the backing plate 46 is fully seated within the recess 44.

When pressurized fluid, such as compressed air, is supplied to fluid inlet port 100, the piston 84 moves to the wall 82, and pushes the piston 88 to an intermediate position within the chamber 80, thereby pushing the backing plate 46 partway toward the printing plate 4, causing the cloth 58 to make contact with the printing plate 4 with sufficient pressure to wipe the printing plate 4 as it turns with the plate cylinder 6. The sponge pad 48 is depressed to further wet the cloth 58. At this position, called the wipe mode, a very low air pressure, for example under 20 psi, allows the sponge pad 48 and the cloth 58 to float over the surface of the plate 4. The wipe mode allows the cloth to lightly collect the debris (hickies) from the plate surface, and allows a light continuous wiping of the plate, resulting in greatly improved printing quality without stopping the press to hand wide the plate. Control of fluid flow to the sponge pad 48 is such that the cleaning fluid does not disrupt the dispersal of ink from the plate to the board.

When pressurized fluid is supplied to the fluid inlet port 102, the piston 88 moves to the end wall 92, causing the backing plate 46 to move further towards the printing plate 4, thus further depressing the sponge pad 48 and causing the bristles 50 to protrude through the weave of the cloth 58 and make contact with the printing plate 4 to provide thorough scrubbing of the contoured surface of the printing plate. At this position, called the wash mode, more aggressive plate cleaning is provided by the bristles whenever the press is not in production. During the wash mode, a higher pressure, for example 30 psi, is supplied to the inlet port 102 to allow a greater force to be applied to the backing plate 46, forcing the bristles to make more forceful contact with the plate. A higher fluid flow rate is also provided to the sponge pad 48 to allow a more thorough washing of the printing plate, which is done offline when printing is not being performed. The wash mode thoroughly soaks the sponge pad to assist with the removal of dried ink from the surface of the printing plate 4.

Separate liquid control is provided for the wipe mode compared to the wash mode.

The various components of the cleaner 2 are controlled from a programmable controller 106. The inlet hose 52 for the cleaning fluid is connected to a solenoid valve 108 which in turn is connected to a liquid pressure vessel 110 with a level sensor 112 connected to the controller 106. The inlet fluid port 110 of the cylinder 38 is connected to a solenoid valve 114. The fluid inlet port 102 is connected to another solenoid valve 116, set at a higher pressure than the valve 114. The valves 114 and 116 are controlled from the controller 106. A compressor 118 supplies compressed air to the pressure vessel 110 and to the cylinder 38.

Figure 10:
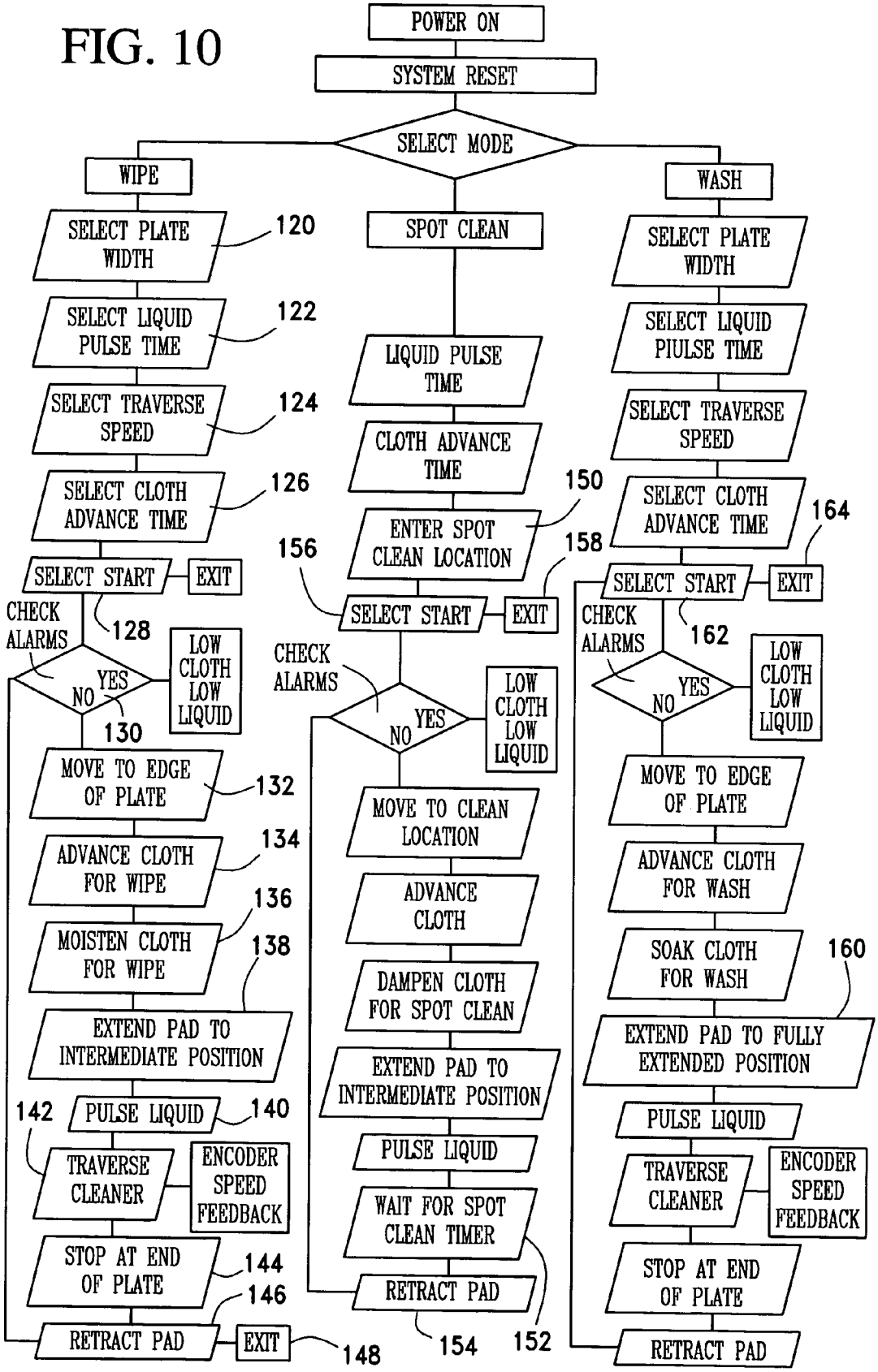
FIG. 10 is a flow chart showing the operation of the flexographic printing plate cleaner of the present invention.

The operation of the cleaner 2 will now be described. Referring to FIG. 10, the cleaner 2 has three cleaning mode, namely the wipe mode, the spot clean mode and wash mode. The wipe mode is used to remove debris (hickies) on the printing plate while printing is ongoing. The spot clean mode is used to clean a single location on the printing plate while the printing press is operating. The wash mode is used to rinse the printing plates while the press is offline.

Under the wipe mode, the printing plate width is selected at 120 to control the traverse distance of the cleaning head 10. A liquid pulse time is selected at 122, which determines the amount of time the solenoid valve 108 is pulsed to inject the cleaning fluid to the sponge pad. The traverse speed for the cleaning head 10 across the printing plate is selected at 124. A cloth advance time is selected at 126 which determines the operation of the rewind motor 62 to draw a new, clean section of the cloth 58 over the sponge pad 48. After the cleaner 2 is started at 128, alarms are checked at 130 for "low cloth" from the sensor 64 or for a low liquid level from the sensor 112. The cleaning head 10 is then moved to the edge of the plate at 132, the cloth is advanced at the selected time at 134, the cloth is moistened at 136 by operating the valve 108 and the sponge pad is extended to the intermediate position at 138 by operating the valve 114 to provide compressed air into the chamber 78. The cleaning fluid is then pulsed at 140 by intermittently operating the valve 108, thereby injecting the cleaning fluid through the passageway 74 to the sponge pad 48. The cleaning head 10 then traverses the length of the printing plate at 142 while the traverse speed is adjusted based on the speed of the plate cylinder 6, as determined by the speed encoder 22. The cleaning head is then stopped at the end of the plate at 144. The cleaning head is then retracted at 146 by providing compressed air through the inlet port 104 into the chamber 80. The whole process may be repeated starting at 130 for as many times as desired until the operator exits at 148.

Under the spot clean mode, the steps are similar to the wipe mode except that cleaning is done for a specific location on the printing plate. The location is entered at 150. In addition, the cleaning head stays engaged with the printing plate for a preselected time at step 152. The cleaning head is retracted at 154, after which the operator can repeat the process for the same location at 156 or exit at 158.

The wash mode is similar to the wipe mode except that the cylinder 38 is extended to its fully extended position at 160. Each cycle can be repeated as many times as desired at 162 until the operator exits at 164.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A flexographic printing plate cleaner, comprising: a) a linear actuator operably mounted relative to a plate cylinder carrying a flexographic printing plate; b) a frame carried by said linear actuator for movement along a path parallel to an axis of rotation of the plate cylinder; c) a double-acting three-position cylinder carried by said frame, said cylinder including a first piston rod having a retracted position, a first extended position and a second extended position; d) a backing plate secured to an exterior end of said first piston rod and movable with said first piston rod; e) a cleaning pad disposed in front of said backing plate and adjacent the flexographic printing plate such that said cleaning pad engages the printing plate at a first pressure when said first piston rod is at said first position, and at a second higher pressure when said first piston rod is at said second position, wherein: said three-position cylinder comprises first and second chamber having respective first and second bottom walls and first and second top walls; first and second pistons disposed with respective first and second chambers; said first piston rod and a second piston rod are secured to respective first and second pistons; said first and second pistons are disposed against said respective first and second bottom walls when said three-stroke cylinder is in said retracted position; said second piston rod is configured to push said first piston when said second piston is actuated to engage against said second top wall to bring said first piston rod to said first extended position; said first chamber is configured such that said first piston is disposed intermediate said first bottom and top walls when in said first extended position; said first piston rod moves to said second extended position when said first piston is actuated to engage against said first top wall; and said first piston is configured to push said second piston against said second bottom wall when said first piston is actuated toward said first bottom wall to assume said retracted position.

2. A flexographic printing plate cleaner as in claim 1, wherein: a) said cleaning pad is a cloth material; and b) a sponge pad is disposed behind said cloth material.

3. A flexographic printing plate cleaner as in claim 1, wherein: a) said cleaning pad is a cloth material; and b) bristles disposed behind said cloth material.

4. A flexographic printing plate cleaner as in claim 3, wherein: a) said bristles are adapted to protrude through said cloth material when said first piston rod is at said second position.

5. A flexographic printing plate cleaner as in claim 1, and further comprising: a) a rewind spindle attached to said frame; b) an unwind spindle attached to said frame; c) said cloth material is in strip form having a first end wound around said rewind spindle and a second end wound around said unwind spindle; and d) a motor for actuating said rewind spindle to advance said cloth material.

6. A flexographic printing plate cleaner as in claim 1, wherein said backing plate includes a passageway communicating with a fluid injection port and said sponge pad.

7. A flexographic printing plate cleaner as in claim 1, and further comprising a speed encoder operably associated with the plate cylinder and said actuator to control the traverse speed of said frame across the length of said plate cylinder during cleaning.

8. A flexographic printing plate cleaner as in claim 1, wherein: a) said second bottom wall includes a second fluid port to actuate said second piston to said second top wall; b) said first bottom wall includes a first fluid port to actuate said first piston to said first top wall; and c) said top wall includes a third fluid port to actuate said first piston to said first bottom wall.

9. A flexographic printing plate cleaner as in claim 2, wherein: a) said sponge pad has top and bottom edges; and b) bristles are disposed along said top and bottom edges.

10. A flexographic printing plate cleaner as in claim 5, and further comprising a low-cloth sensor.

11. A flexographic printing plate cleaner, comprising: a) a linear actuator operably mounted relative to a plate cylinder carrying a flexographic printing plate; b) a cleaning head carried by said linear actuator for movement along a path parallel to an axis of rotation of the plate cylinder; c) said cleaning head having a first position away from the printing plate and a second position in engagement against the printing plate to clean the printing plate while the plate cylinder is rotating; and d) a speed encoder operably associated with the plate cylinder and said actuator to control the traverse speed of said cleaning head across the length of the printing plate during cleaning, said cleaning head including a double-acting three-position cylinder including a first piston rod having a retracted position, a first extended position and a second extended position, said cleaning head further comprising a backing plate secured to an exterior end of said first piston rod and movable with said first piston rod, a cloth material, and bristles disposed behind said cloth material, said bristles being adapted to protrude through said cloth material when said first piston rod is at said second position.

12. A flexographic printing plate cleaner as in claim 11, wherein: a) said actuator includes a toothed endless belt; b) a motor drive to drive said belt; and c) said cleaning head is operably secured to said belt to move said cleaning head across the printing plate along a path parallel to the axis of rotation of the plate cylinder.

13. A flexographic printing plate cleaner as in claim 11, wherein said cleaning head includes a cleaning cloth and a sponge pad disposed behind said cloth.

14. A flexographic printing plate cleaner as in claim 13, wherein said cleaning head includes bristles disposed behind said cloth and along upper and lower edges of said sponge pad.

15. A flexographic printing plate cleaner as in claim 13, wherein said cleaning head comprises: a) a rewind spindle; b) an unwind spindle; c) said cloth material is in strip form having a first end wound around said rewind spindle and a second end wound around said unwind spindle; and d) a motor for actuating said rewind spindle to advance said cloth material.

16. A flexographic printing plate cleaner as in claim 11, wherein said backing plate includes a passageway communicating with a fluid injection port and said sponge pad.

17. A flexographic printing plate cleaner, comprising: a) a linear actuator operably mounted relative to a plate cylinder carrying a flexographic printing plate; b) a cleaning head carried by said linear actuator for movement along a path parallel to an axis of rotation of the plate cylinder; c) said cleaning head including a cleaning pad comprising cloth and bristles protruding through said cloth, said cleaning pad having a first position away from the printing plate and a second position in engagement against the printing plate wherein said cloth and said bristles are in engagement with said printing plate for cleaning.

18. A flexographic printing plate cleaner as in claim 17, wherein said cleaning head includes a sponge pad disposed behind said cloth.

19. A flexographic printing plate cleaner as in claim 18, wherein: a) said sponge pad has top and bottom edges; and b) said bristles are disposed along said top and bottom edges.

20. A flexographic printing plate cleaner as in claim 17, wherein: a) said cleaning head includes cylinder having at least a fully retracted position corresponding to said first position and an extended position corresponding to said second position; b) a backing plate operably associated with said cylinder; c) said sponge pad is disposed in front of said backing plate.

21. A flexographic printing plate cleaner as in claim 20, wherein said baking plate includes a passageway communicating with a fluid injection port and said sponge pad.

* * * * *